US008572899B1

(12) United States Patent
Pearce et al.

(10) Patent No.: US 8,572,899 B1
(45) Date of Patent: Nov. 5, 2013

(54) GUTTER GUARD MESH SECURED USING ADHESIVE

(75) Inventors: Michael Pearce, Raymond Terrace (AU); Dale Ward, Toronto (AU)

(73) Assignee: Leaf Free Pty Ltd, New South Wales (AU)

( * ) Notice: Subject to any disclaimer, the term of this patent is extended or adjusted under 35 U.S.C. 154(b) by 0 days.

(21) Appl. No.: 13/704,326

(22) PCT Filed: Jun. 30, 2011

(86) PCT No.: PCT/AU2011/000822

§ 371 (c)(1), (2), (4) Date: Dec. 14, 2012

(87) PCT Pub. No.: WO2012/000051

PCT Pub. Date: Jan. 5, 2012

Related U.S. Application Data

(60) Provisional application No. 61/359,931, filed on Jun. 30, 2010.

(30) Foreign Application Priority Data

Jun. 30, 2010 (AU) ..... 2010902913

(51) Int. Cl.
*E04D 13/064* (2006.01)
*B32B 7/12* (2006.01)

(52) U.S. Cl.
USPC ..... 52/12; 428/317.1; 428/317.7; 428/317.3; 428/209; 428/40.1

(58) Field of Classification Search
USPC ..... 52/10–15; 428/40.1, 41, 99, 100, 428/208–209, 352, 354, 347, 317.1, 317.3, 428/317.7; 24/67 AR, 306; 427/208; 210/473–474
See application file for complete search history.

(56) References Cited

U.S. PATENT DOCUMENTS

| | | | | |
|---|---|---|---|---|
| 4,351,134 | A * | 9/1982 | Clarkson | 52/12 |
| 4,839,206 | A * | 6/1989 | Waldenberger | 428/41.5 |
| 5,406,754 | A * | 4/1995 | Cosby | 52/12 |
| 6,572,945 | B2 * | 6/2003 | Bries et al. | 428/40.1 |
| 8,006,438 | B2 * | 8/2011 | Higginbotham | 52/12 |
| 2006/0059825 | A1 * | 3/2006 | Wiercinski et al. | 52/506.01 |
| 2007/0089372 | A1 | 4/2007 | Hammond et al. | |
| 2009/0300995 | A1 * | 12/2009 | Nikolopoulos | 52/12 |

FOREIGN PATENT DOCUMENTS

| | | | |
|---|---|---|---|
| AU | 2007200508 | A1 | 8/2007 |
| DE | 29711089 | U1 | 9/1997 |
| DE | 102004043349 | A1 | 3/2006 |

* cited by examiner

*Primary Examiner* — Jeanette E. Chapman
(74) *Attorney, Agent, or Firm* — Richard M. Goldberg

(57) ABSTRACT

A gutter guard mesh for application to the gutter/roof interface of a roof includes a length of woven mesh or the like having an array of apertures dimensioned to maximize traversal by rain water and minimize traversal of accumulated debris from the roof wherein at least a first edge of the mesh is fitted on a first side with a double sided acrylic foam closed cell tape having acrylic adhesive on both sides and on a second opposing side with a double sided butyl tape wherein the free side of the foam tape is available for adherence to the gutter via the acrylic adhesive and the free side of the butyl tape is available for adherence of a protective laminate.

7 Claims, 4 Drawing Sheets

GUTTER GUARD MESH SECURED USING ADHESIVE

CROSS-REFERENCE TO RELATED APPLICATIONS

The present application claims priority from Australian Provisional Patent Application 2010902913 and U.S. Provisional Patent Application 61/359,931 the content of which is incorporated herein by reference.

INTRODUCTION TO THE INVENTION

This invention relates to the protection of roof gutters and incursion of roof debris into gutters, and in particular, relates to an improved gutter guard incorporating heavy-duty mesh and adapted for adhesive application to a gutter and associated roofing.

BACKGROUND TO THE INVENTION

The provision of a retro-fittable mesh guard to provide an effective cover for the open gutters associated with many roofing systems in a manner to effectively deflect debris accumulating on the roof and simultaneously maximise the transmission of water falling on the roof whilst straightforward in principal, has proved elusive in practice; particularly when a high quality and durable adhesive system is sought in combination with a robust and heavy duty meshing so as to maximise the simplicity of application and minimise the need for mechanical fixture.

The original proposals for self-adhesive gutter guarding included the use of lightweight fibreglass mesh having a double sided adhesive, applied along the edge thereof. The early adhesive bonding tapes were not UV stabilised and were subject to premature deterioration resulting in bonding failure resulting in an unacceptable short life to these early products.

In order to address these premature failures of the early gutter guard meshes, it was found that a double sided adhesive tape applied to the mesh edge and a thin metal laminate applied directly opposing the other side of the mesh could, under pressure, provide a mesh having a metal laminate on one edge and a self-adhesive region on the opposing edge, such that application to the roof and gutters of buildings, could theoretically provide protection to the adhesive region of the mesh and improve longevity of these earlier products. Whilst the improvements to the fibreglass mesh added to the lifespan of this resulting product, it was found that fibreglass as a mesh material, lacks sufficient strength, stability and longevity that would be desirable in harsher environments. Moreover, the inability of fibreglass mesh to resist ember attack, renders its application limited, particularly in high bushfire attack regions. In response to such commercial demands, modified gutter guard products of the type previously described were prepared using analogous techniques with the use of high quality stainless steel and similar meshes. However, it was revealed that the increased resilience of the thicker, less pliable meshes such as stainless steel, provided an unacceptable increase in the pressure applied to the bonding action between the layers of materials and the laminate. Accordingly, such meshes were found to be unsatisfactory as they experienced bond failure. In order to address such premature bond failures, a range of physical fastening accessories were developed of the like disclosed in Australian Patent 2006201429. Whilst the improvements provided with such accessories were valuable, it was found that the installation and labour involved, in addition to the potential breaking or interference with the roofing iron, did not provide a full solution to the problem at hand.

An alternative approach to addressing the adhesive failures of the heavier mesh, included experimentation to increase the thickness of the adhesive tapes. However, the manufacturing problems encountered in the preparation and application of a thicker tape, in addition to the potential compromise to the products stability by the use of a heavier tape, including laminate separation, also failed to provide a suitable answer to the problem at hand.

Further investigation into the limitations encountered with the use of thicker tapes, revealed that double-sided adhesive tapes made up of polyurethane and acrylic foam, retain a physical memory, even after the tape has been applied to the mesh and pressed together under extreme pressure; such that, within relatively short period of time, the tape foam compound would seek to retain its original form, leading to high stress on the adhesive bonds formed and thereby leading to premature bond failure.

Accordingly, one object of this invention is to provide an improved gutter guard self adhesive mesh comprising a heavyweight mesh, having an adhesive tape applied to one edge thereof, being adapted for self adhesion to a gutter and roofing system.

SUMMARY STATEMENTS OF THE INVENTION

In a first aspect the invention provides a gutter guard mesh for application to the gutter/roof interface of a roof comprising a length of woven mesh or the like having an array of apertures dimensioned to maximise traversal by rain water and minimise traversal of accumulated debris from said roof wherein at least a first edge of said mesh is fitted on a first side with a double sided acrylic foam closed cell tape having acrylic adhesive on both sides.

The foam tape is preferably characterised by a solventless UV cured acrylic polymer core of about 1000 microns having visco-elastic properties. Most preferably each side of the tape core is coated with about 50 micron thick solvent based modified acrylic-adhesive to enhance the initial tack and wet-out characteristics. The tape includes an acrylic foam closed cell construction and is most preferably T711GN.

In another aspect the invention provides a gutter guard mesh for application to the gutter/roof interface of a roof comprising a length of woven mesh or the like having an array of apertures dimensioned to maximise traversal by rain water and minimise traversal of accumulated debris from said roof wherein at least a first edge of said mesh is fitted on a first side with a double sided acrylic foam closed cell tape having acrylic adhesive on both sides and on a second opposing side with a double sided butyl tape wherein the free side of said foam tape is available for adherence to said gutter via said acrylic adhesive and the free side of said butyl tape is available for adherence of a protective laminate.

The mesh preferably includes a protective laminate being a metallic or other durable protective strip to provide protection to the adhesive layers once applied to the gutter.

The butyl tape on the second opposing side of the mesh preferably incorporates a polyethylene reinforcing mesh embedded into the core thereof so as to provide additional strength.

The butyl tape preferably comprises the following formulation:

Base materials PE net 2-3% (wt)

Adhesive

Butyl rubber 17-23%

Calcium carbonate 33-37%
Thermoplastic resin 17-23%
Process oil 10-15%
Manganese dioxide 1-2%
Others 1-2%
Release paper
PE laminated paper 5-8%
Release agent 0-0.4%

The woven mesh is preferably chosen from stainless steel or aluminium and has a mesh made up of 12 to 14 strands per inch, a wire diameter of 0.25 mm and 2 mm apertures throughout the mesh. The aluminium mesh may be coated to provide additional protection and the coating may be coloured to match the roof colour.

In another aspect the invention provides a method of protecting an exposed gutter comprising the application of a gutter guard mesh as previously described to the lip of a gutter and to the roof to which it is attached.

DETAILED DESCRIPTION

Figure 1:
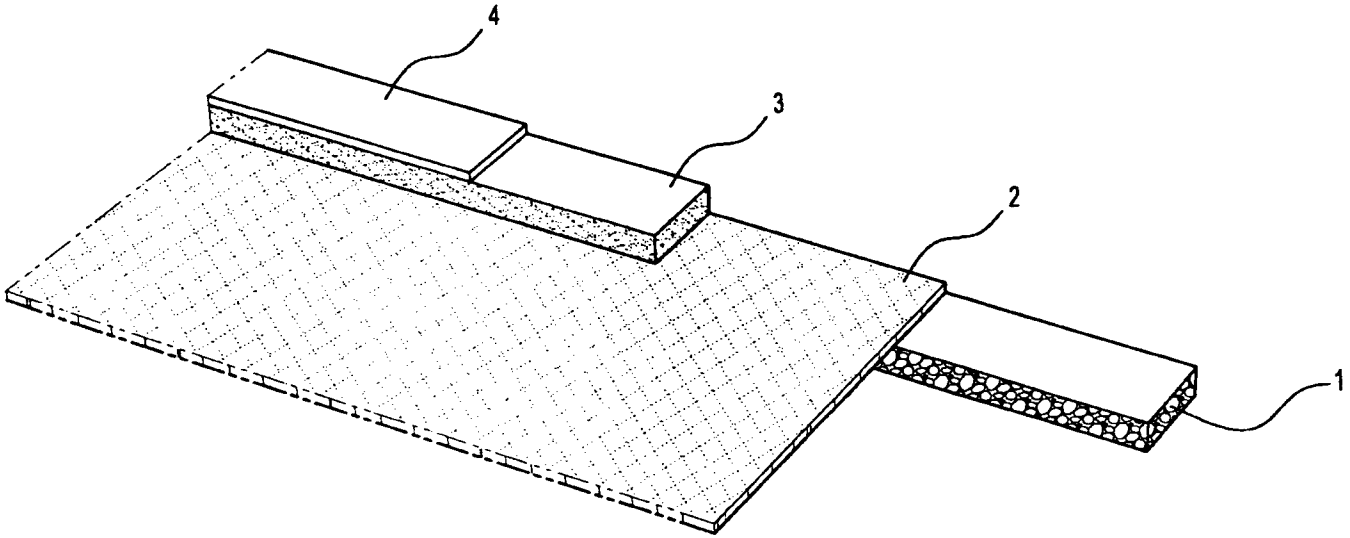
FIG. 1 is a perspective view of gutter guard mesh according to one embodiment of the present invention.

The invention will now be described with reference to FIGS. 1, 2 and 3 which show a particularly preferred embodiment of the invention including the application of the adhesive layers to the first and second side of a stainless steel or other highly durable mesh so as to provide a durable, reliable and self-adhesive mesh strip for application to gutters, rooves and the like.

Referring now to the Figures, the gutter guard mesh of the invention comprises a length of woven mesh 2 of stainless steel, aluminium or other durable material, having an array of apertures dimensioned to maximise traversal of rain water and minimise traversal of accumulated debris from the roof 8 when the mesh is applied so as to bridge the roof 8 and an attached gutter 7. The mesh is preferably a wire of 0.25 mm thickness at 12 to 14 strands per inch with 2 mm apertures. The mesh apertures are shown in the figures as phantom schematic only and do not necessarily represent the actual aperture dimensions. The mesh is designed for self-adhesion to the gutter along a first edge of the mesh, with a double-sided acrylic foam closed cell tape 1, applied to the first underside of one edge of the mesh. The foam tape has acrylic adhesive on both sides thereof and therefore adheres to the mesh on one side and on the free side, is available for adhesion to the gutter edge. The construction of the foam tape preferably includes a closed cell foam. The opposing side, being the second side of the same first edge of the mesh, may be provided with a double-sided butyl tape 3. The butyl tape 3 is self-adhesive per se and is adhered to the second opposing side of the mesh. The application of pressure, effectively sandwiches the mesh between the butyl tape and the foam tape applied to the first opposing side. The mesh is therefore provided with different adhesives on the first and second sides and the free side of the butyl tape is then fitted with a protective laminate 4, preferably taking the form of an aluminium or other metallic protective laminate.

In this manner, a first edge of the mesh may be built up with a layer of differing adhesives on the under and upper side, which provide for the differing adhesive forces required to ensure the mesh remains adhered to the gutter whilst also retaining adhesion of the protective laminate 4.

The butyl layer is preferably reinforced with a polyethylene mesh embedded into the core thereof so as to provide further integral strength to the butyl tape layer.

In this manner, the provision of multiple layers of differing adhesives of varying qualities have allowed for the necessary flexibility and compliance of the overall adhesive. The differing adhesive requirements for adhesion to the mesh in contrast to adhesion to the metal laminate and/or the gutter or roof, have utilised the best adhesive qualities of the differing adhesive layers and in effect, provided a gutter guard product having up to seven different bonding interfaces. The different boding interfaces maximise the ability of a mesh so formed to bond to a gutter and/or roof on one side, and a metallic laminate on the exposed side and with the intervening layers sandwiched to the mesh, so as to provide a durable, robust adhesive system not prone to memory failings and having a high level of adhesion to the appropriate substrate.

The adhesive tape and resultant gutter guard product is adapted for ready application to gutters and roofs and in particular, a selection of an appropriate mesh to a variety of roofing situations found in a variety of jurisdictions.

The improved gutter mesh product as disclosed provides a high level of resistance to UV damage by virtue of the metal laminate on the outer edge thereof, with the acrylic foam giving a basis and support for adhesion via an acrylic adhesive to the gutter. The stainless steel or aluminium mesh is chosen most preferably having approximately 12 to 14 strands per inch, a wire diameter of about 0.25 mm and apertures of 2 mm.

Figure 2:
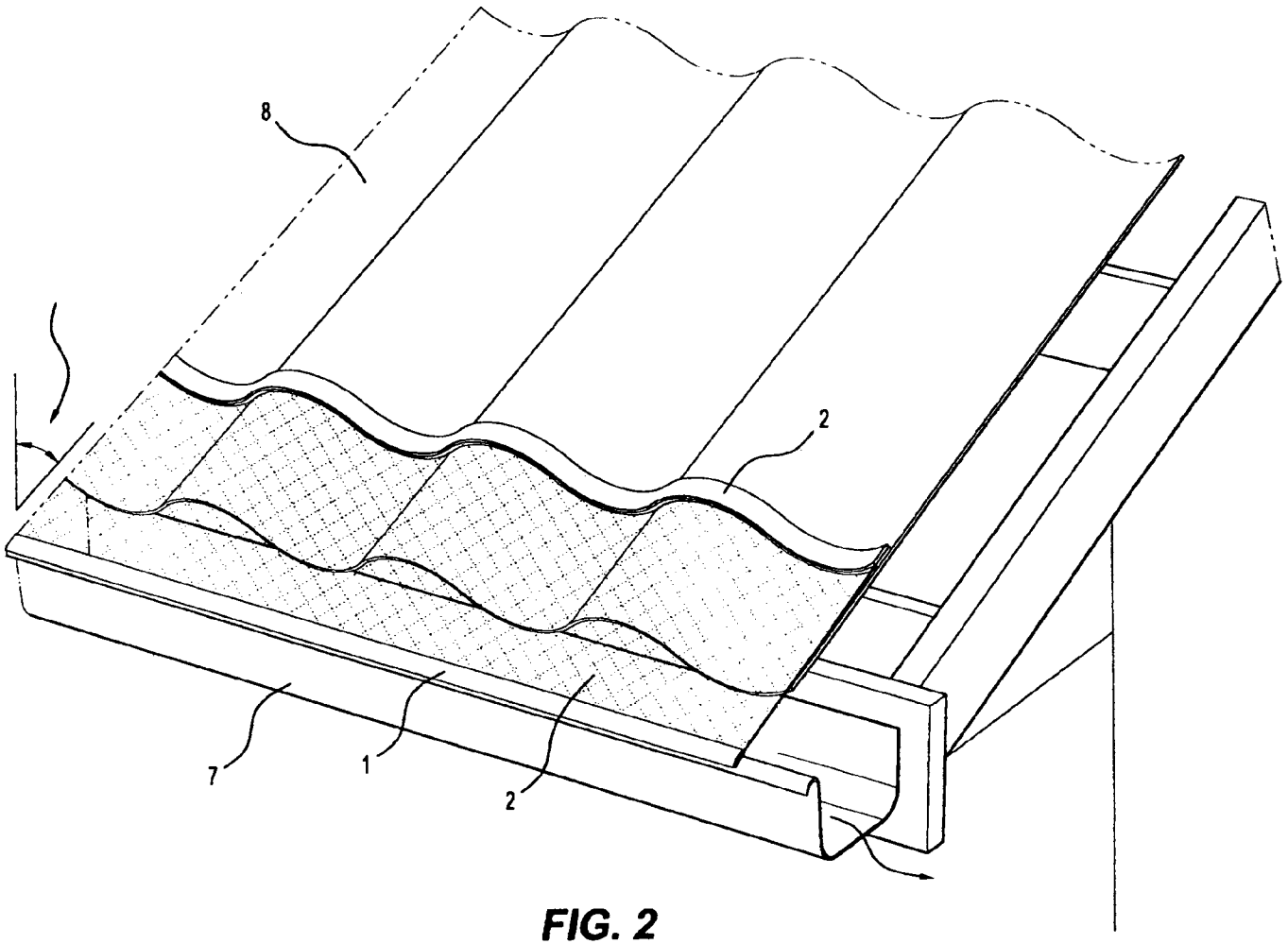
FIG. 2 is a perspective view showing installation of the gutter guard mesh of FIG. 1 to a metal corrugated roofing.
Figure 3:
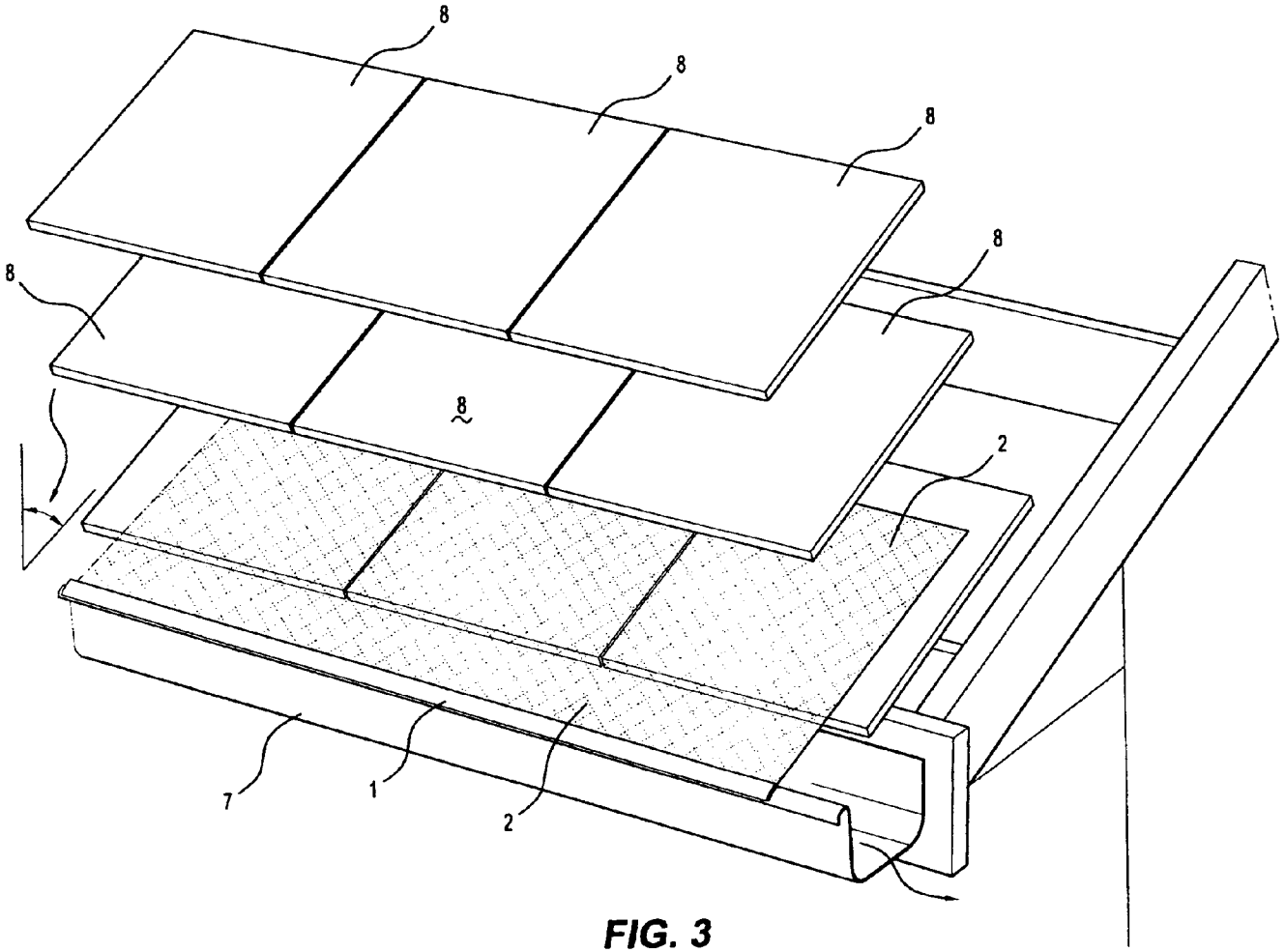
FIG. 3 is a perspective view showing installation of the gutter guard mesh of FIG. 1 to a slate asphalt or tiling roofing.

The installation of the gutter guard of the invention as shown in FIGS. 2 and 3, demonstrate that the gutter guard product when installed on metal corrugated roofing 8 as shown in FIG. 2, or slate asphalt or alternative tiling 8 as shown in FIG. 3, provides the appropriate mesh slope so as to displace the bulk of debris falling onto a roof and/or fire embers, which will slide off the roof via the mesh of the invention, without interruption. The provision of a suitable mesh and dimensioning thereof, allows the simultaneous traversal of rainwater which filters through the mesh to the unobstructed roof gutter 7 for collection and storage.

The installation of a gutter guard in accordance with the angle of application to the vertical as detailed in FIGS. 2 and 3 provides particular advantages as the disclosed angles have been found to provide optimised water and debris separations thereby maximising the protective function of the mesh whilst maximising the collection of water.

Figure 4:
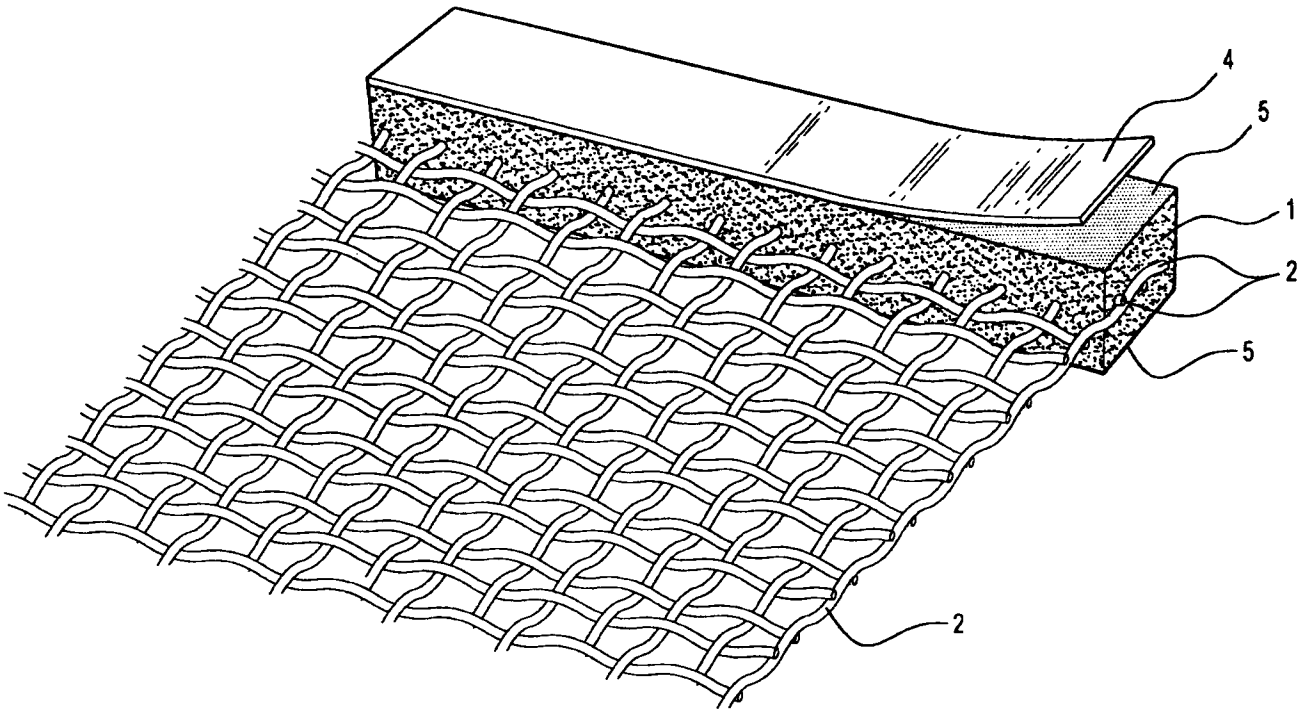
FIG. 4 is a perspective view of gutter guard mesh according to another embodiment of the present invention.

In another embodiment shown in FIG. 4, a simplified version of the invention is made up of a length of woven mesh as previously described, with the first edge of the mesh being fitted on a first side with a double sided acrylic foam closed cell tape having acrylic adhesive on both sides. In this embodiment, the optional use of the butyl tape to match the double sided acrylic foam closed cell tape is omitted and with the application of suitable pressure, the single layer of double sided acrylic foam closed cell tape can be caused to migrate through the apertures of the mesh so as to fully integrate along the first edge of the mesh and provide exposed tape either side of the edge by virtue of migration through the mesh so as to then provide a first exposed adhesive edge for application to the guttering of a roof with the second exposed edge 5 being on the up side, then available for application of a metallic laminate of the like to provide a high level of durability to the mesh once applied.

FIG. 4 details the mesh being impregnated into the foam compound, the compound preferably being T711GN.

For the purposes of understanding this embodiment, FIG. 4 should be read with Item 1 and 3 as shown in FIG. 1 representing the foam closed cell tape post migration through the mesh.

It will be appreciated by persons skilled in the art that numerous variations and/or modifications may be made to the invention as shown in the specific embodiments without departing from the scope of the invention as broadly described. The present embodiments are, therefore, to be considered in all respects as illustrative and not restrictive.

What is claimed is:

1. A gutter guard mesh for application to a gutter/roof interface of a roof comprising:

a length of woven mesh-like material having an array of apertures dimensioned to maximise traversal by rain water and minimise traversal of accumulated debris from said roof;

a double sided acrylic foam closed cell tape having acrylic adhesive on both sides, fitted on a first side of a first edge of said mesh-like material; and a double sided butyl tape fitted on an opposing second side of the first edge of said mesh-like material, wherein a free side of said foam tape is available for adherence to said gutter via said acrylic adhesive and a free side of said butyl tape is available for adherence of a protective laminate.

2. A mesh according to claim 1, wherein said protective laminate is one of:

a durable metallic strip, and another durable protective strip.

3. A mesh according to claim 1, wherein said butyl tape incorporates a polyethylene mesh imbedded into a core thereof.

4. A mesh according to claim 1, wherein said butyl tape comprises the following:

base materials PE net 2-3% (wt);

adhesive;

butyl rubber 17-23%;

calcium carbonate 33-37%;

thermoplastic resin 17-23%;

process oil 10-15%;

manganese dioxide 1-2%;

other materials 1-2%;

release paper;

PE laminated paper 5-8%; and release agent 0-0.4%.

5. A mesh according to claim 1, wherein said foam tape includes a solventless UV cured acrylic visco-elastic polymer core about 1000 microns thick.

6. A mesh according to claim 5, wherein said polymer core is coated with a solvent based acrylic adhesive to a thickness of about 50 micron.

7. A method of protecting a gutter comprising the application of a gutter guard mesh according to claim 1, comprising the step of bridging a lip of a gutter and a roof to which the gutter guard mesh is attached.

* * * * *